US005145506A

United States Patent [19]

Goldstein et al.

[11] Patent Number: 5,145,506

[45] Date of Patent: Sep. 8, 1992

[54] METHOD OF BONDING METAL CARBIDES IN NON-MAGNETIC ALLOY MATRIX

[75] Inventors: David Goldstein, Adelphi; Scott M. Hoover, Laruel, both of Md.

[73] Assignee: The United States of America as represented by the Secretary of the Navy, Wasington, D.C.

[21] Appl. No.: 627,937

[22] Filed: Jul. 5, 1984

[51] Int. Cl.[5] ..... C22C 29/08; B22F 3/16

[52] U.S. Cl. ..... 75/240; 75/236; 419/17; 419/18; 419/23; 419/28

[58] Field of Search ..... 75/240, 236; 419/23, 419/17, 18, 28

[56] References Cited

U.S. PATENT DOCUMENTS

| | | | |
|---|---|---|---|
| 3,700,434 | 10/1972 | Abkowitz et al. | 419/23 |
| 3,756,787 | 9/1973 | Lange et al. | 75/236 |
| 3,918,138 | 11/1975 | Nemeth et al. | 75/240 X |
| 4,497,660 | 2/1985 | Lindholm | 75/240 |
| 4,910,091 | 3/1990 | Garg et al. | 428/552 |
| 5,053,074 | 10/1991 | Buljan et al. | 75/236 |
| 5,067,979 | 11/1991 | Kiyota et al. | 75/243 |
| 5,069,869 | 12/1991 | Nicolas et al. | 419/28 |
| 5,071,473 | 12/1991 | Reeder et al. | 75/240 |

FOREIGN PATENT DOCUMENTS

| | | | |
|---|---|---|---|
| 93105 | 8/1978 | Japan | 75/240 |

OTHER PUBLICATIONS

Hausner, H. H., *Handbook of Powder Metallurgy*, Chemical Publishing Co., NY, N.Y. (1973) pp. 1-14.

*Primary Examiner*—Donald P. Walsh
*Assistant Examiner*—Daniel J. Jenkins
*Attorney, Agent, or Firm*—Kenneth E. Walden; Roger D. Johnson

[57] ABSTRACT

A non-magnetic, wear resistant composite of from 10 to 45 volume percent of titanium carbide or tungsten carbide particles bonded in a matrix of a nickel-titanium alloy wherein nickel comprises from 53 to 62 weight percent of the alloy with the remainder being essentially titanium.

16 Claims, 2 Drawing Sheets

(400 X)

(800 X)

(800 X)

(400 X)

(400 X)

(400 X)

METHOD OF BONDING METAL CARBIDES IN NON-MAGNETIC ALLOY MATRIX

BACKGROUND OF THE INVENTION

This invention relates to metal composites and more particularly to composites of refractory materials in metal alloy matrices.

In U.S. Pat. No. 3,416,342 entitled, "Method for Working and Bonding Refractory Metals and Alloys," which issued to Goldstein et al on Dec. 17, 1968, NiTi alloys known as NITINOL alloys were used as matrix materials enabling processing of refractory elements such as tungsten and molybdenum. Such a composite is a refractory metal within an alloy; there is wetting between the refractory metal and the matrix alloy. The composite can be hot worked, and may be hard nor wear resistant.

Hard and wear resistant refractory metal carbides in cobalt, steel, or titanium alloys such as commercial alloys as Ferro-Tic or Titan 80 are magnetic however, and can not be hot worked.

The refractory metal carbides do not offer a hard, wear resistant, non-magnetic, high electrical resistance, oxidation and corrosion resistant, hot formable, tough, ductile, saw resistant composite structure. A material with all these attributes would be useful in many industrial applications ranging from rollers to vault construction materials.

SUMMARY OF THE INVENTION

Accordingly, an object of the invention is to provide a new composite structure.

Another object of this invention is to provide a new composite structure that is non-magnetic and wear resistant.

A further object of this invention is to provide a new composite structure that is oxidation and corrosion resistant.

Yet another object is to provide a new composite structure that is hot formable, tough and ductile.

A still further object of this invention is to provide a new composite structure that is saw resistant.

These and other objects of this invention are achieved by providing a non-magnetic, wear resistant composite of (1) from about 10 to 45 volume percent of particles of a metal carbide which is titanium carbide or tungsten carbide, wherein the particles are from more than 0.045 mm to less than 1.00 mm (−18+325 standard mesh) in size when the metal carbide is titanium carbide and from more than 0.300 mm to less than 2.00 mm (−10+50 standard mesh) size when the metal carbide is tungsten carbide; with the remainder of the composite being a matrix of a nickel-titanium alloy which is composed of from 53 to 62 weight percent of nickel with the remainder being essentially titanium.

DETAILED DESCRIPTION OF THE PREFERRED EMBODIMENT

Figure 1B:
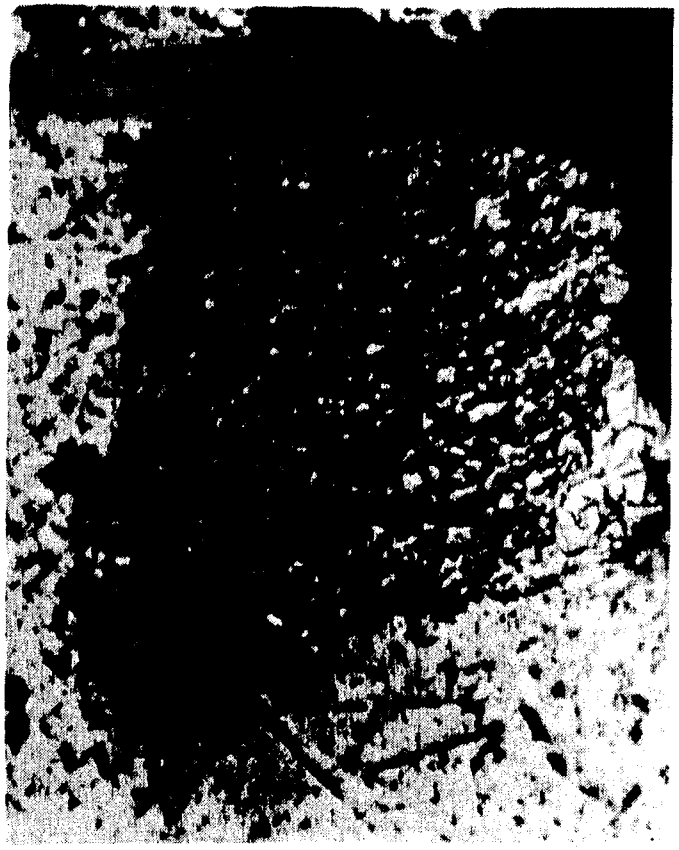
FIGS. 1a, 1b, 2, and 3 are photographs showing the grain structures of composites produced in examples 1, 2, and 3, respectively.

Note: Mesh as used herein refers to standard mesh or standard sieve number. The *Handbook of Chemistry and Physics* 61st. ed. 1980–81, page F-161, provides a table listing standard sieve numbers (mesh) versus size in mm or microns.

The present invention provides non-magnetic, wear resistant composites of titanium carbide (TiC) or tungsten carbide (WC) particles in a nickel-titanium alloy matrix. The nickel-titanium alloy comprises from about 53 to about 62, and preferably from 54 to 58 weight percent nickel, with the remainder being essentially titanium. TiC ôr WC particles containing ferromagnetic binders are not suitable for these composites as these binders will make them magnetic.

The titanium carbide or tungsten carbide particles comprise from about 10 to about 45, and preferably from 20 to 33 volume percent of the composite, with the remainder being the nickel-titanium alloy.

In the first step of preparing the composite, titanium carbide powder or tungsten carbide powder is throughly blended with nickel-titanium alloy powder. The composition of these powders is the same as the composition desired for the final composite, given above.

As examples 1 and 2 demonstrate, TiC particles in a wide range of sizes may be used. A preferred range is −18 +325 mesh (less than 1 mm but greater than 0.045 mm). The size of the nickel titanium alloy particles when TiC is used is −60 mesh (less than 0.25 mm) and preferably −100 mesh (less than 0.149 mm). Note that the TiC and the nickel-titanium alloy particles have similar densities.

If WC particles are used, they are from −10 to +50 mesh (less than 2 mm but more than 0.300 mm) in size. Preferably, the WC particles are from −10 to +30 mesh (from less than 2.0 mm to more than 0.6 mm) in size. The WC particles are considerably more dense than the nickel-titanium alloy particles, and they tend to separate out during the blending step. As a result, it is preferable to use a mixture of large and small nickel-titanium particles, with the small particles comprising from 50 to 70 volume percent and the large particles the remainder. The large particles are flakes of up to 0.25 inches long by less than 0.002 inches thick. The small particles are −60 mesh (less than 0.25 mm) and preferably −100 mesh (less than 0.149 mm) in size. The flakes by interlocking trap and keep the much heavier WC particles from separating out. The small nickel-titanium alloy particles fill in the spaces left between the flakes. Note that after the sintering and hot working steps, the nickel-titanium alloy will be in the form of a single metal matrix.

In the second step, the mixure of metal carbide (TiC or WC) and nickel-titanium powders is put into on flexible container (e.g., elastomeric dam) and cold isostatically pressed (CIP) in hydraulic fluid (e.g., an oil) at high pressure to form a green preform. An isostatic pressure of 60,000 psi produces poor results; 80,000 psi, fair results; and 120,000 psi, excellent results. The isostatic pressure applied in this step is 100,000 psi or more, and preferably 120,000 psi or more. The upper limit of pressure applied is limit by practical factors such as cost, limits of the equipment, etc.

In the third step, the green perform of metal carbide and nickel-titanium alloy is placed in a ductile metal container, such as a stainless steel can which is evacuated to a pressure of less than 100 microns and preferably less than 25 microns and then sealed. The green perform is then sintered at a temperature of from 900° to 1195° C. and preferably from 1165° to 1195° C.

In step 4 the composite is hot worked in the metal container until the cross sectional area of the composite is reduced by a minimum of 25 percent. This may be done by hot swaging at a temperature of from 850° to 950° C. or by extruding at a temperature of from 1050° to 1090° C. At this time true bonding between the metal carbide (TiC or WC) and the nickel-titanium alloy and 99.+ percent of theoretical density is achieved.

The metal carbide/nickel-titanium alloy composite can be removed from the metal container, if desired, by machining or pickling.

The TiC/nickel-titanium alloy and WC/nickel titanium composites are non-magnetic and wear resistant. In addition composites containing 20 or more percent by volume of WC particles of −10 +30 mesh (less than 2 mm but greater than 0.60 mm) in size are resistant to the tungsten carbide edged saws such as the Grit Edge® saws produced by the Remington Arms Company.

To more clearly illustrate this invention, the following examples are presented. It should be understood, however, that these examples are presented merely as a means of illustration and are not intended to limit the scope of the invention in anyway.

EXAMPLE 1

Figure 1A:
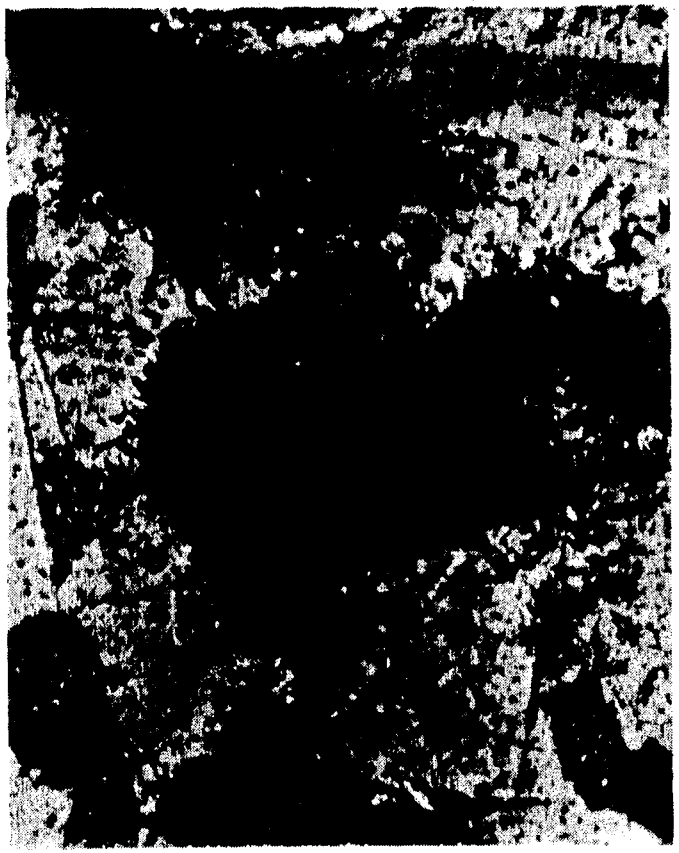

A bar (P4) was prepared as follows: TiC was crushed to −18 +30 mesh, blended with −60 mesh NITINOL (NiTi alloy) in an inverted cone blender, packed in a elastometric dam and cold isostatically pressed in an oil medium to 140,000 psi. Following this compaction it was removed from the dam, placed in a AISI 304 steel tube which was closed at one end and which was evacuated to a pressure of 40 microns. The tube was then welded closed completely and the assembly heated to a sintering temperature of 900° C. for two hours. The assembly was hot swaged from this temperature, reducing the cross sectional area by approximately 75%. The bonding achieved between the TiC and NiTi is shown in FIG. 1. No intermediate phase forms between the angular carbide and the rounded NiTi grains, but wetting has occurred, producing a true bond directly between the TiC and NiTi. In this example the TiC constituted 45 volume percent of the consolidated structure. In this instance the structure was slightly magnetic due to the ferromagnetic binders used to form the original massive TiC material which was crushed to produce the powder used for blending. This need not be the case, as shown in the following example 2.

EXAMPLE 2

Figure 2:
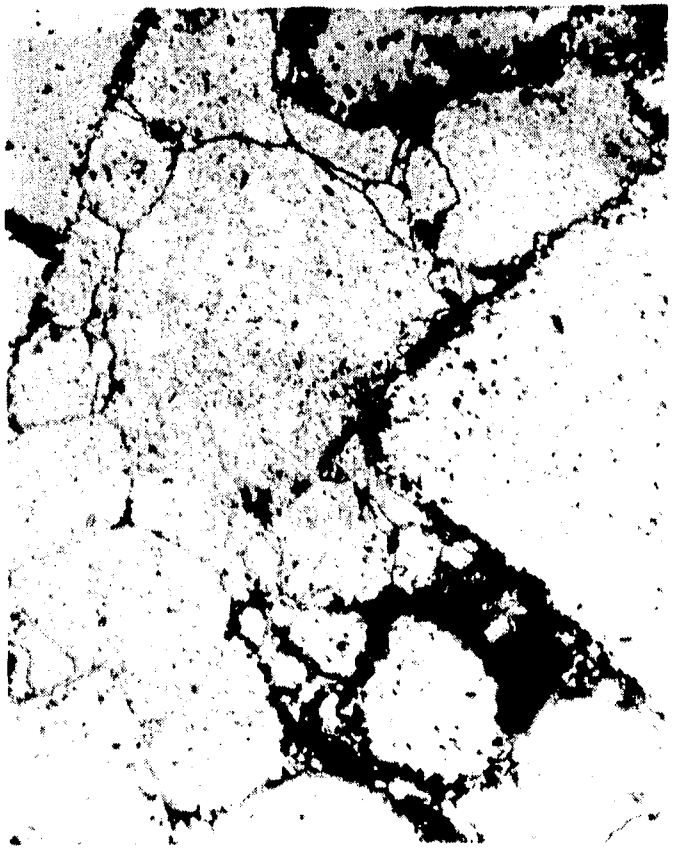

Pure TiC, mesh size −150 +325 was blended with −60 mesh NiTi. Pressing, sintering and swaging were performed the same as in example 1, except that sintering was at 1000° C. for 2 hours. As is shown in metallographic view FIG. 2, the carbide-NiTi interface of the very fine structure remains discrete, although agglomeration of the carbide has produced a eutectic like structure. This specimen contains 10 volume percent carbide.

EXAMPLE 3

Figure 3:
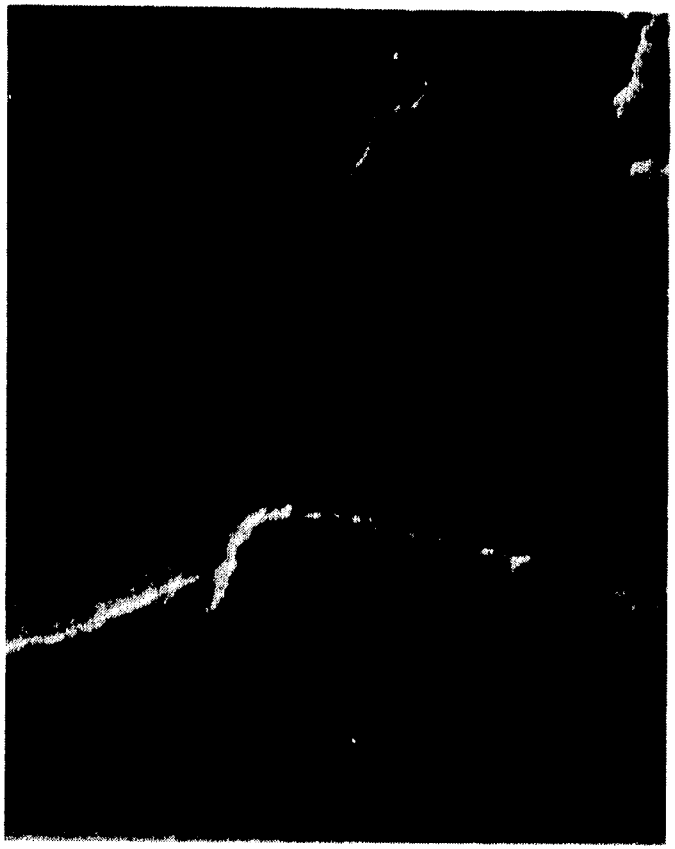

Using the procedure of example 1, a construction with 20 volume percent WC, −18 +50 mesh, with NiTi +60 mesh, was prepared. Sintering was at 900° C. for 2 hours. The metallographic structure is shown in FIG. 3, again illustrating the excellent bond generated by NiTi with a carbide particle.

Obviously numerous modifications and variations of the present invention are possible in light of the above teachings. It is therefore to be understood that within the scope of the appended claims the invention may be practiced otherwise than as specifically described herein.

What is claimed as new and desired to be secured by Letters Patent of the United States is:

1. A non-magnetic, wear resistant composite comprising:
   (1) from about 10 to about 45 volume percent of particles of a metal carbide selected from the group consisting of titanium carbide and tungsten carbide wherein the particles are from more than 0.045 to less than 1.0 mm in size when the metal carbide is titanium carbide and from greater than 0.300 mm to less than 2.00 mm in size when the metal carbide is tungsten carbide; with
   (2) the remainder of the composite being a single matrix of a nickel-titanium alloy which is composed of from 53 to 62 weight percent of nickel with the remainder being essentially titanium;

wherein the particles of metal carbide are uniformly distributed throughout the nickel-titanium alloy matrix and wherein the composite is formed by sintering and hot working until the density of the composite is more than 99 percent of the theoretical density of the composite.

2. The composite of claim 1 wherein the nickel-titanium alloy is composed of from 54 to 58 weight percent of nickel with the remainder being essentially titanium.

3. The composite of claim 1 wherein the metal carbide particles comprise from 20 to 33 volume percent of the composite.

4. The composite of claim 1 wherein the metal carbide is titanium carbide.

5. The composite of claim 1 wherein the metal carbide is tungsten carbide.

6. The composite of claim 5 wherein the tungsten carbide particles are from more than 0.600 mm to less than 2 mm in size.

7. A process for preparing a non-magnetic, wear resistant composite comprising the following steps in order:
   (1) blending a mixture of
      (a) from 10 to 45 volume percent of a metal carbide powder selected from the group consisting of titanium carbide and tungsten carbide wherein when titanium carbide is used the particles are from more than 0.045 mm to less than 1.00 mm in size but when tungsten carbide is used the particles are from more than 0.300 mm to less than 2.00 mm in size; with the remainder of the mixture being
      (b) a nickel-titanium alloy powder wherein the alloy comprises from 53 to 62 weight percent of nickel with the remainder being essentially titanium, wherein when the metal carbide is titanium carbide the nickel-titanium alloy particles are less than 0.250 mm in size, but when the metal carbide is tungsten carbide the nickel-titanium alloy particles are a mixture of from 50 to 70 volume percent of small particles of less than 0.250 mm in size with the remainder being flakes of up to 0.25 inches long but less than 0.002 inches thick;

(2) isostatically pressing the mixture of metal carbide and nickel titanium alloy particles formed in step (1) at a pressure of 100,000 psi or more to form a green preform;

(3) sealing the green perform in a steel container which has been evacuated to a vacuum of less than 100 microns, wherein the walls are of a thickness to permit hot working;

(4) sintering the green perform at a temperature of from 900° to 1195° C.;

(5) hot working the sintered composite from step (4) until the cross-sectional area has been reduced by at least 25% percent and the composite is at near theoretical density; and (6) cooling the titanium carbide/nickel-titanium alloy composite to room temperature and removing it from the steel container.

8. The process of claim 7 wherein the metal carbide powder comprises from 20 to 33 volume percent of the mixture.

9. The process of claim 7 wherein the nickel-titanium alloy comprises from 54 to 58 weight percent of nickel with the remainder being essentially titanium.

10. The process of claim 7 wherein the metal carbide is titanium carbide.

11. The process of claim 7 wherein the metal carbide is tungsten carbide.

12. The process of claim 7 wherein the isostatic pressure used in step (2) is 120,000 psi or more.

13. The process of claim 7 wherein in step (3) the container is evacuated to a vacuum of less than 45 microns.

14. The process of claim 7 wherein the green perform is sintered in step (4) at a temperature of from 1165° to 1195° C.

15. The process of claim 7 wherein the sintered composition is hot worked in step (5) by extruding at a temperature of from 1050° to 1090° C.

16. The process of claim 7 wherein the sintered composition is hot worked in step (5) by swaging at a temperature of from 850° to 950° C.

* * * * *